US006405967B1

(12) United States Patent
Sturm et al.

(10) Patent No.: US 6,405,967 B1
(45) Date of Patent: Jun. 18, 2002

(54) DEVICE FOR PIVOTING A CREEL OF A TEXTILE MACHINE

(75) Inventors: Christian Sturm, Krefeld; Alexander Marx, Brüggen, both of (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/733,200

(22) Filed: Dec. 8, 2000

(30) Foreign Application Priority Data

Dec. 8, 1999 (DE) ..... 199 59 195

(51) Int. Cl.[7] ..... B65H 54/44; B65H 54/54

(52) U.S. Cl. ..... 242/485.3; 242/485.8; 242/486.2

(58) Field of Search ..... 242/485.3, 485.8, 242/486.2

(56) References Cited

U.S. PATENT DOCUMENTS

| | | | | | |
|---|---|---|---|---|---|
| 202,549 | A | * | 4/1878 | Kershaw | 242/485.3 |
| 2,665,077 | A | * | 1/1954 | Stange | 242/485.3 |
| 2,930,538 | A | * | 3/1960 | Miller | 242/485.3 |
| 3,082,969 | A | * | 3/1963 | Burnell | 242/485.8 |
| 3,282,517 | A | * | 11/1966 | Chavis | 242/485.3 X |
| 3,301,496 | A | * | 1/1967 | Furst | 242/485.3 |
| 4,195,790 | A | * | 4/1980 | Reiners et al. | 242/485.3 |
| 4,332,065 | A | * | 6/1982 | Hauri | 242/485.3 X |
| 4,635,866 | A | | 1/1987 | Kamp et al. | |
| 6,006,510 | A | | 12/1999 | Coenen | |

FOREIGN PATENT DOCUMENTS

| | | | | |
|---|---|---|---|---|
| DE | 868 867 | | 3/1953 | |
| DE | 893 322 | | 10/1953 | |
| DE | 1 154 743 | | 9/1963 | |
| DE | 29 39 612 | B1 | 9/1980 | |
| DE | 34 07 766 | A1 | 9/1985 | |
| DE | 198 17 363 | A1 | 10/1999 | |
| JP | 60082572 | A * | 5/1985 | ..... 242/485.3 X |
| JP | 62-215472 | | 9/1987 | |
| JP | 63-267671 | | 11/1988 | |
| WO | WO89/08071 | | 9/1989 | |

OTHER PUBLICATIONS

German Search Report.

* cited by examiner

*Primary Examiner*—Michael R. Mansen
*Assistant Examiner*—Minh-Chau Pham
(74) *Attorney, Agent, or Firm*—Kennedy Covington Lobdell & Hickman, LLP

(57) ABSTRACT

A device for pivoting a creel of a textile machine, which holds a bobbin in contact with a roller during the winding process. The creel (2) is fastened on a shaft (5) defining a pivot axis. A lifting device (9) connected with the creel (2) has a lever (10) fixed with the shaft (5) against relative rotation. An arresting element (12) seated on the shaft (5) can be alternatingly coupled to the shaft (5) or a fixed holding element (21). When the arresting element (12) is coupled with the shaft (5), potential energy is stored in an energy storage device, which is released when the connection changes from the shaft (5) to the holding element (21), whereby the lever (10) and the shaft (5) are abruptly moved toward the arresting element (12). The device makes it possible to break the contact between the cheese (1) and the drive roller (3) quickly and dependably in case of a power failure. Interference with grasping an upper yarn end, as well as damage to the yarn and yarn positioning errors, can be avoided.

9 Claims, 3 Drawing Sheets

DEVICE FOR PIVOTING A CREEL OF A TEXTILE MACHINE

CROSS-REFERENCES TO RELATED APPLICATIONS

This application claims the benefit of German patent application DE P 19959195.4, filed Dec. 8, 1999, herein incorporated by reference.

FIELD OF THE INVENTION

The present invention relates to a device for pivoting a creel of a textile machine, and more particularly to such a creel which holds a bobbin in contact under pressure with a roller during a winding process, wherein the creel is pivotably seated around a pivot axis and connected with a lifting device by means of which the bobbin and the roller can be selectively separated.

BACKGROUND OF THE INVENTION

Devices for pivoting a creel are known in various embodiments in connection with textile machines which produce cheeses. For example, German Patent Publication DE 198 17 363 A1 describes a pivotably seated creel of a textile machine which receives a cheese frictionally driven by a drive roller which is connected with a means for generating rotational torque. The contact pressure between the cheese held by the creel and the drive roller is controlled by means of a stepping motor, which can be angularly displaced such that the pressure distribution is matched to the build-up of the bobbin. At the end of bobbin winding, the creel with the full cheese is pivoted into a bobbin removal position by means of a rotating movement generated by the stepping motor. Lifting of the cheese by pivoting the creel with the stepping motor breaks the contact between the cheese and the drive roller.

The winding process is interrupted during bobbin changes, cop changes, and also following yarn breaks. To shorten the length of the interruption it is customary to brake the rotational movement of the cheese. If braking occurs while there is still contact between the cheese and the drive roller, damage to the yarn and errors in the yarn position on the surface of the cheese occur. Even with a free run-out of a cheese resting against the drive roller, but without breaking the contact between the cheese and the drive roller, it is possible that damage to the yarn or the bobbin can occur with yarn of particularly fine count or delicate yarns when there are considerably different surface speeds of the cheese and the drive roller. The faster the contact between the cheese and the drive roller is broken by separating the cheese from the drive roller at a yarn interruption, for example in the case of a yarn break, the less will be the danger that the yarn end is worked into the surface of the cheese by the drive roller which makes it considerably more difficult or even prevents the grasping of the upper yarn by a suction nozzle during the subsequent yarn joining and restart process.

A lifting device of the type over which the present invention seeks to improve is known from German Letters Patent 868 867, which is operative in case of a yarn break to effect an abrupt lifting of the bobbin from the drive drum by means of a creel in the form of a bobbin carrier frame. The extensive and space-limiting design of the rod linkages is disadvantageous in this device. Since such rod linkages must be provided for the lifting device at each winding head in order to make possible the desired rapid lifting of the creel, a very large structural outlay is required for a bobbin winding machine having a plurality of winding heads. The structural space thusly required at each winding head uses space which is only available at the winding heads to a limited degree and which might be needed for the installation and function of further desired or required arrangements. Moreover, the winding head described in German Letters Patent 868 867 can only be manually restarted. The creel is pivotable around an axis, but the lifting device acts on the creel far outside of this pivot point and only permits a very limited pivot range of the creel.

It is not possible with any of the above mentioned devices to dependably break the contact between the cheese and the drive roller in case of a power failure. The above described deficiencies occurring because of the different surface speeds of the drive roller and the bobbin cannot be avoided by means of the known devices.

SUMMARY OF THE INVENTION

It is accordingly an object of the present invention to provide an improved pivoting device for a creel to address the aforementioned deficiencies of the known creel lifting devices.

Briefly summarized, the present invention provides, in combination, a textile machine creel for holding a bobbin, e.g., a cheese, in driven surface contact with a drive roller during a winding process and a device for abruptly pivoting the creel out of contact with the drive roller. In accordance with the present invention, the creel comprises a shaft defining a pivot axis about which the creel is selectively moveable relative to the drive roller, and the pivoting device comprises a lever fixedly connected with the shaft for integral movement therewith. A holding element is disposed in a fixed position relative to the shaft, and an arresting element extends between the shaft and the holding element for connection alternately with the shaft or the holding element. An energy storage device is operative when the arresting element is coupled with the shaft for storing potential energy and is operative to release the stored potential energy when the arresting element is coupled with the holding element for abruptly moving the lever to the arresting element for pivoting the shaft.

The invention is distinguished by requiring only little outlay of expense. The transfer of the pivot movement takes place simply and advantageously via the shaft which forms a common pivot axis for the creel and the lever. The contact between the cheese and the drive roller is cancelled without delay and abruptly in case of a current failure, but the device can also be used for breaking contact by separating the cheese and the drive roller in case of a yarn break or a cleaning cut. The present invention also does not hinder the pivoting of the creel over a large pivot range into a position suitable for removing full cheeses.

The energy storage device is preferably embodied as a helical spring acting on the lever and the arresting element, without any further elements for transferring force to the energy storage device being necessary. Use of a helical spring entails particularly low material costs as well as a low assembly outlay, and little structural space is required. In contrast to devices wherein a pneumatic cylinder is charged with compressed air for breaking the contact between the bobbin and the drive roller, a helical spring offers the advantage that in case of a power failure it is not necessary to make compressed air available for the operation of the device in accordance with the invention. However, in the case of performing a contact break in pneumatically operated systems, the demand for compressed air occurring simultaneously at many work stations in case of a power failure can endanger the operational dependability.

A holding element embodied as a toothed segment with teeth on its interior permits an assured fixation of the arresting element which is simple to perform at any moment during the winding process, and therefore also with any bobbin diameter. The arresting element has a piston-and-cylinder lifting assembly for performing the processes of both coupling and uncoupling the arresting element. The fixation of the arresting element by the coupling thereof with the holding element, which is firmly connected with the machine frame, is performed by the movement of the piston rod in the cylinder in the direction toward the holding element. This movement simultaneously causes the uncoupling of the arresting element from the shaft. To uncouple the arresting element from the holding element, the piston rod is moved in the cylinder in the opposite direction. Besides canceling the fixation of the arresting element, the movement of the piston rod away from the holding element toward the shaft causes a coupling of the arresting element with the shaft so as to be fixed therewith against relative rotation. Thus, the coupling processes, as well as the uncoupling processes, are provided by the movement of a single structural element. The mass to be moved and the lifting travel of the piston rod are very small. Thus, it is possible to perform such coupling and uncoupling particularly rapidly and abruptly.

In a preferred embodiment, the shaft, and therefore the creel, are connected with a drive element by means of which the creel can be pivoted in both directions. Potential energy can be supplied to the energy storage element by means of a pivoting movement performed by the drive element, wherein the cheese moves toward the drive roller. The drive element is advantageously designed as a stepping motor, which can be displaced in predetermined angular steps. Stepping motors of this type require little space and are manufactured in large numbers. The use of a stepping motor as the drive element constitutes a simple and cost-effective attainment of the object of the invention. It is possible to omit an additional drive element for moving the lifting device if an existing stepping motor, which can be employed for displacing the creel, is used.

Thus, the drive element can be used for several functions in connection with the subject of the invention. Pivoting the cheese, or the empty bobbin, into the winding position for the winding process can be accomplished with the drive element. Simultaneously with this movement the energy storage device can be charged. During the winding process the contact pressure between the cheese and the drive roller can be controlled by means of the drive element in such a way that the pressure distribution is matched to the build-up of the bobbin. The drive element can perform the additional function of pivoting the creel, even over a large pivot range, into a removal position for full cheeses.

An arresting element which is designed in the shape of a lever is compact and saves space and is well suited for receiving the piston-and-cylinder lifting assembly. Once the arresting element has been coupled with the shaft in a manner fixed against relative rotation, the imaginary center lines of the lever and the arresting element preferably form an angle between about 10 degrees and about 90 degrees, in particular approximately 45 degrees. In this manner, it is possible, following the uncoupling of the arresting element, to create the pivoting movement by means of the release of energy from the energy storage device, which cancels the contact between the bobbin and the roller, particularly effectively via the lever.

The device in accordance with the invention represents a compact, space-saving and cost-effective attainment of the object of the invention. The desired cancellation of contact between the roller and the cheese in case of a power failure can be accomplished rapidly and dependably by means of the device, and in this way it is possible to prevent interference with grasping of a broken or cut upper yarn end for performing a yarn joining operation, as well as to prevent damage to the yarn and yarn positioning errors. The function can be performed in case of a power failure, but also when the compressed air supply fails. Besides triggering the separation of the bobbin and the drive roller, it is also possible to automatically perform the restart of the winding station. Thus, it is possible to reduce down time and to increase the productivity of the winding station or of the textile machine.

Further details, features and advantages of the present invention will be explained by means of an exemplary embodiment represented in the drawings.

DETAILED DESCRIPTION OF THE PREFERRED EMBODIMENT

Figure 1:
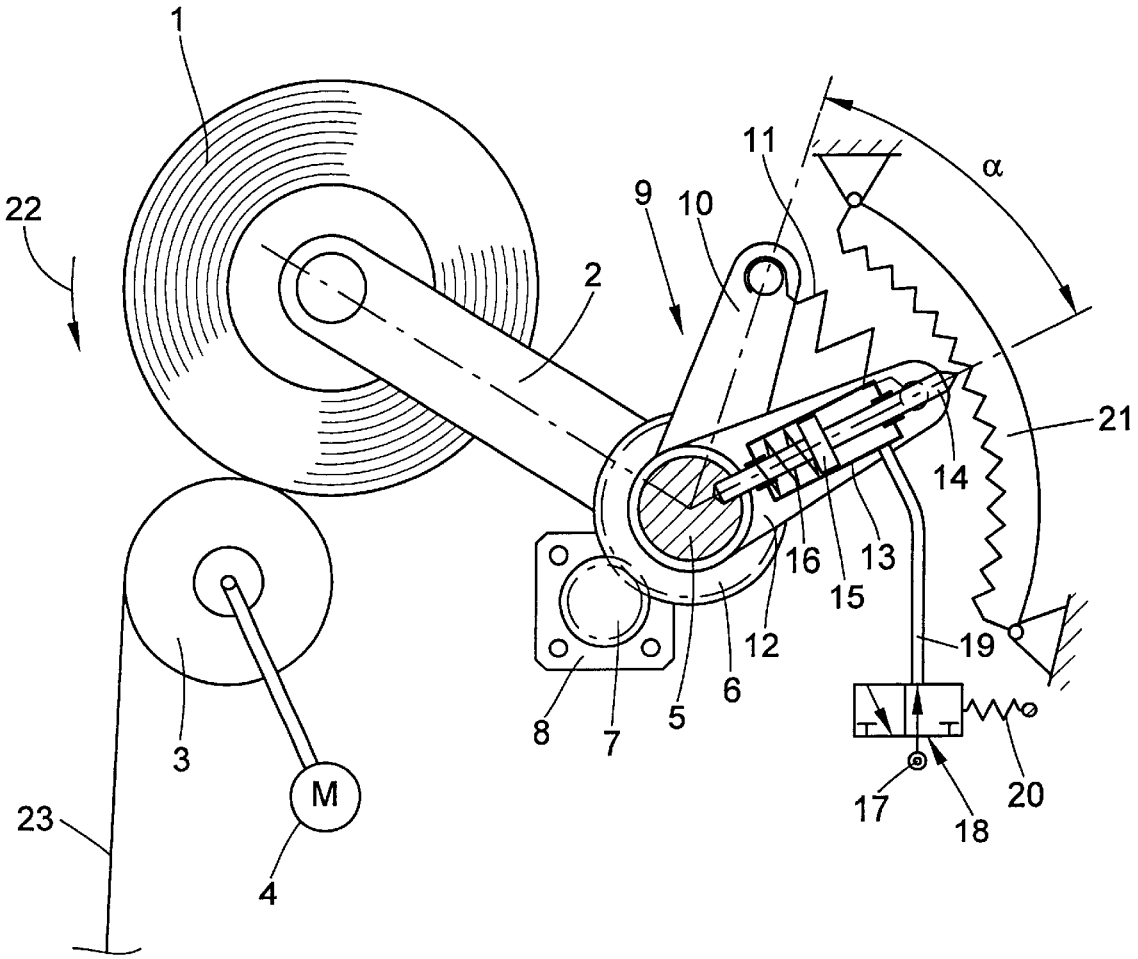
FIG. 1 is a greatly simplified schematic side elevational view, partially in section, of a winding station of a textile machine with a cheese in the winding position.

Referring now to the accompanying drawings and initially to FIG. 1, a winding station of a textile machine is shown with a cheese 1 held in a creel 2 and caused to rotate by means of friction surface driving contact with a drive roller 3. The rotary motion of the drive roller 3 is generated by a motor 4. The creel 2 is connected, fixedly with a shaft 5 against relative rotation thereof The shaft 5 pivots in a bearing fixedly connected with the winding station housing but not represented for reasons of simplicity. The pivot drive is shown in a simplified form by a gear wheel 6, which is also connected fixedly with the shaft 5 for integral rotation, meshing with a pinion gear 7 whose angular position is changeably controlled by the stepping motor 8.

In accordance with the principle cited in the above mentioned German Patent Publication DE 198 17 363 A1, a defined torque can be exerted on the creel 2 by means of the stepping motor 8, by means of which the contact pressure between the cheese 1 and the drive roller 3 is controlled. Here, the contact pressure is matched to the build-up of the bobbin. The winding station has a lifting device 9 for the abrupt separation of the contact between the cheese 1 and the drive roller 3. The lifting device 9 includes a lever 10 which is also fastened on the shaft 5 fixedly against relative rotation. The outer free end of the lever 10 away from the shaft 5 is connected by means of a helical spring 11 with the outer free end of an arresting element 12 facing away from the shaft 5.

The arresting element 12 comprises a pneumatic piston-and-cylinder lifting assembly, comprising a piston 15 on a piston rod 14 movable back and forth in a cylindrical bore 13 in the arresting element 12. The arresting element 12 is seated on the shaft 5, which defines the common pivot axis for the lever 10 and the arresting element 12. In the position represented in FIG. 1, the end of the piston rod 14 facing the shaft 5 interlockingly enters into a bore of the shaft 5. Thus the arresting element 12 is coupled fixedly with the shaft 5 against relative rotation in this position. The helical spring 11, which acts on the lever 10, as well as on the arresting element 12, is elongated between the lever 10 and the arresting element 12 and therefore this prestress of the spring 11 charges it with stored potential energy. The imaginary center lines of the lever 10 and the arresting element 12 form an angle a therebetween of about 45 degrees. Compressed air acts on the piston 15 and maintains the piston rod 14 in the position represented in FIG. 1 against the force of a restoring spring 16 disposed within the cylinder 13. Compressed air is supplied to the lifting cylinder 13 from the compressed air source 17 via the valve 18 and the line 19. The valve 18 is designed as a 3/2-way valve. In the position represented, the valve 18 is supplied with current, and the restoring spring 20 is therefore maintained under tension. The valve 18 can be maintained in this position by a solenoid, not represented. The holding element 21, embodied as a toothed segment, is arranged fixedly on the machine frame and is disposed concentrically in respect to the shaft 5.

In the winding position represented in FIG. 1, the cheese 1 rotates in the direction of the arrow 22 during the winding process. This rotary movement is imparted by friction to the cheese 1 by the drive roller 3, rotating in the opposite direction. The contact pressure between the roller 3 and the cheese 1 is controlled and matched to the build-up of the bobbin. The yarn 23 is wound up in the process.

Figure 2:
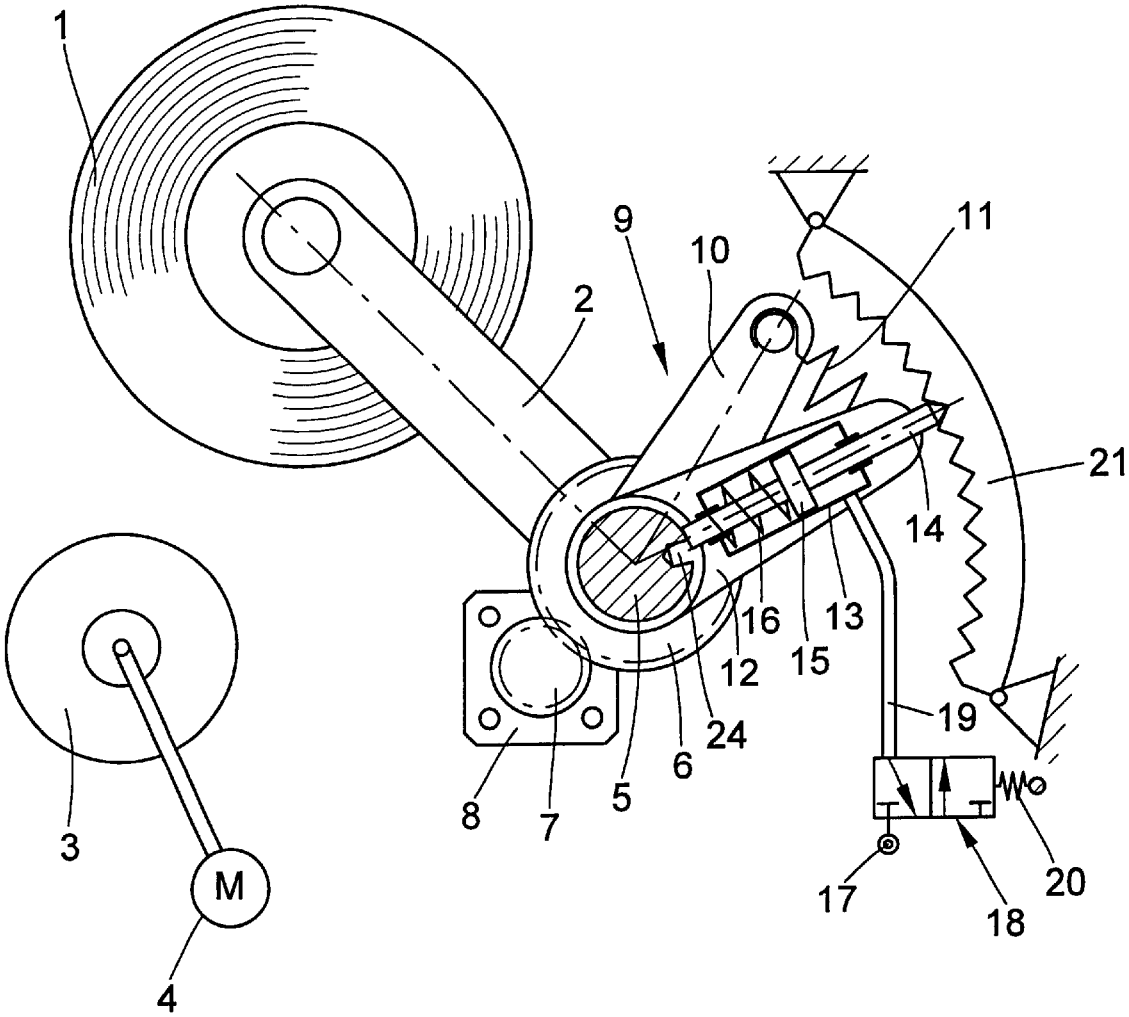
FIG. 2 is another schematic side elevational view of the winding station of FIG. 1 showing the cheese in the position lifted off the drive roller.

If a power failure occurs, the valve 18 is no longer supplied with electricity and is no longer held in the switching position represented in FIG. 1. Instead, the restoring spring 20 causes the valve 18 to switch into the position represented in FIG. 2. In this position, the lifting cylinder 13 is evacuated via the line 19, and the restoring spring 16 displaces the piston 15, and therefore the piston rod 14, into the position indicated in FIG. 2. The compressed air supply from the compressed air source 17 is interrupted. The end of the piston rod 14 facing away from the shaft 5 snaps interlockingly into the inside teeth of the holding element 21. Thereupon, the arresting element 12 is coupled to the holding element 21 and is fixed in place relative thereto, and can no longer be pivoted around the pivot axis constituted by the shaft 5. In the course of being connected to the holding element 21, the other end of the piston rod 14 is pulled out of the bore 24 of the shaft 5 by the movement of the piston rod 14. As a result, the shaft 5 becomes pivotable in relation to the arresting element 12. The potential energy stored in the form of the prestressing of the helical spring 11 is released and generates a force acting on the lever 10. In the representation in FIG. 2, this causes an abrupt pivoting movement in a clockwise direction of the lever 10 and of the integrally connected creel 2, until a force equilibrium is reached. In the process the end of the piston rod 14 slides on the circumference of the shaft 5. This pivoting movement of the creel 2 abruptly breaks the contact between the cheese 1 and the drive roller 3. Interference with the grasping of the upper yarn end, as well as damage to the yarn and yarn positioning errors caused by the different run-down properties of the cheese 1 and the drive roller 3 are assuredly prevented. The abrupt breaking of the contact between the cheese 1 and the drive roller 3 in case of a yarn break can be similarly triggered in a simple way by terminating electrical current to the valve 18 when a yarn break signal occurs.

In accordance with the invention, an alternative embodiment, not represented, of the device for pivoting the creel 2 can contain means for damping oscillating movements occurring with the sudden pivot process. The means can be a hydraulically acting damping cylinder, for example.

When not charged with a current, the stepping motor 8 has a negligibly small torque. This is a result of the design of the stepping motor 8, which operates by means of field coupling. An alternative embodiment with elastic transfer elements, such as described in German Patent Publication DE 198 17 363 A1, in addition allows a certain play for movement. The pivot movement of the creel 2 required for breaking the contact between the cheese 1 and the drive roller 3 can therefore proceed unhindered.

Figure 3:
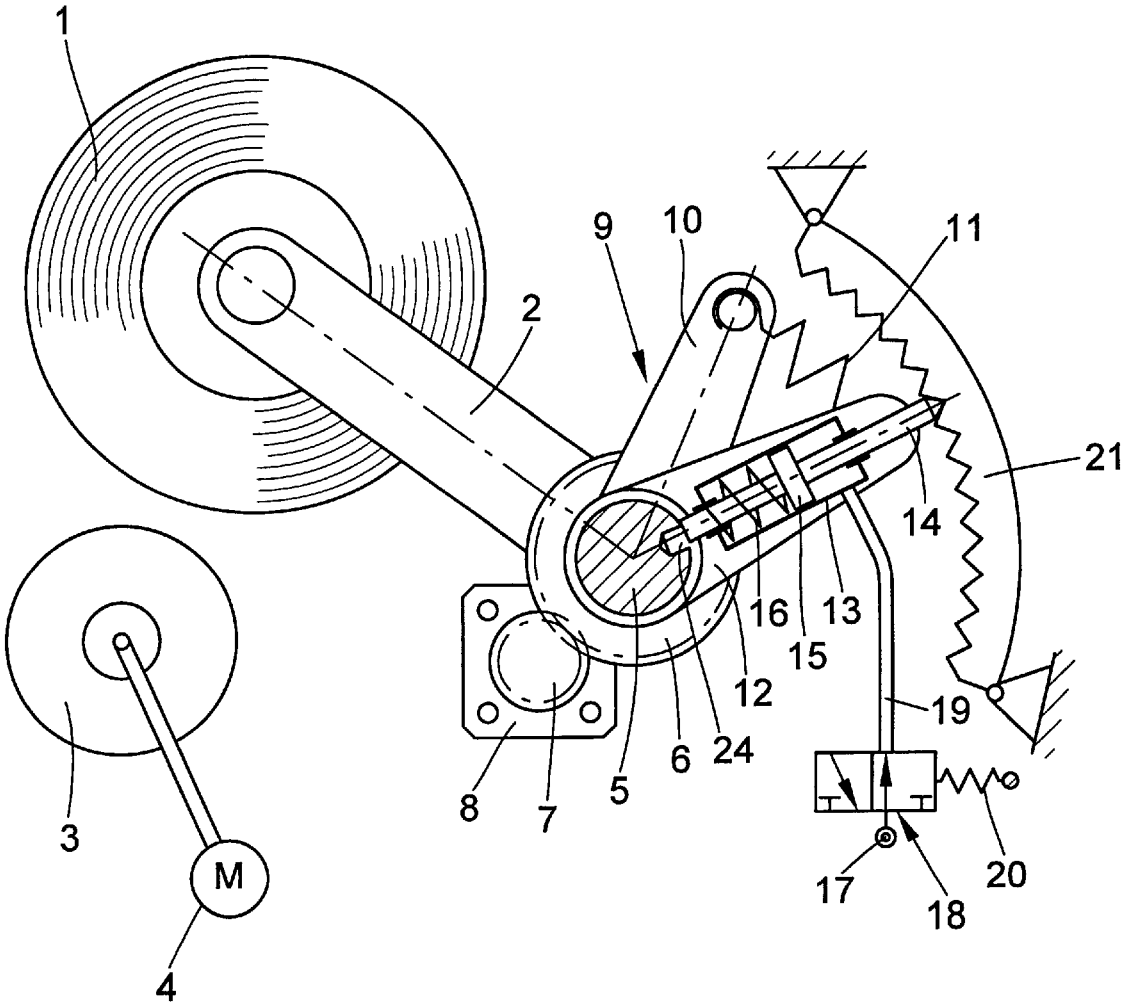
FIG. 3 is another schematic side elevational view of the winding station of FIG. 1 showing the cheese in an intermediate position in the course of the movement from the lifted position into the winding position.

Once the power has been restored, or the valve 18 again is provided with current, the switching state of the valve 18 as represented in FIG. 3 occurs. The switched position of the valve in FIG. 3 is the same as in FIG. 1. The piston 15 is again acted upon by compressed air from the compressed air source 17 via the line 19. At this time the creel 2 still is in the position represented in FIG. 2. Here, the shaft 5, which is fixedly connected with the creel 2, assumes an angular position such that the piston rod 14 and the bore 24 in the shaft 5 are not aligned. The end of the piston rod 14 rests on the circumference of the shaft 5. In this position the piston 15 cannot be moved in spite of being acted upon by compressed air, and the piston rod 14 remains snapped into the holding element 21 and fixed in place. A pivot movement of the creel 2, and therefore of the cheese 1, in the direction towards the drive roller 3 into the winding position is caused by means of the stepping motor 8. An intermediate position of the creel 2 during this pivot movement is represented in FIG. 3. Since the arresting element 12 continues to remain connected with the holding element 21 and fixed in place, the helical spring 11 is prestressed by the lever 10, which also performs this pivoting movement. When the creel 2 has reached the position which it had occupied at the time of the power failure or power interruption, the piston rod 14 and the bore 24 are again aligned, and the end of the piston rod 14 can enter the bore 24 by means of the compressed air acting against the force of the restoring spring 16. Thereupon, the lifting device 9 is again pivotable with respect to the holding element 21. The winding position as represented in FIG. 1 is taken up again, a possible yarn break can be repaired and the winding process can continue.

Further embodiments of a device in accordance with the invention alternatively to the represented exemplary embodiment are possible. For example, the lifting cylinder 13 and the valve 18 can be designed in such a way that the valve 18, when supplied with current, blocks the compressed air supply to the lifting cylinder 13 and evacuates the lifting cylinder 13. Then the piston rod 14. is maintained in the bore 24 of the shaft 5 by the spring force of a restoring spring. When the current for the valve 18 is interrupted, the valve 18 takes up a different switched position, in which the piston 15 is charged with compressed air. Because of this the piston rod 14 is pulled out of the bore 24 of the shaft 5 against the spring force, snaps into the inside teeth of the holding element 21 and in this way permits a relative movement between the lever 10 and the arresting element 12, by which the pivot movement for lifting the cheese 1 is triggered. After the restoration of current to the valve 18, the lifting cylinder 13 is evacuated and, following the pivoting movement of the shaft, the piston rod 14 is again pushed into the bore 24 of the shaft 5 by the spring force.

To remove the full cheese 1 from the creel 2, the latter can be pivoted, in a clockwise direction in the representation in FIG. 1, by means of the stepping motor 8 into a bobbin removal position without the pivoting process being hampered by the lifting device 5 or limited to an undesirable degree. Even a pivot range of approximately 160 degrees can be handled without problems.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. In combination, a textile machine creel for holding a bobbin in driven surface contact with a drive roller during a winding process, the creel comprising a shaft defining a pivot axis about which the creel is selectively moveable relative to the drive roller, and a device for abruptly pivoting the creel out of contact with the drive roller, the pivoting device comprising a lever fixedly connected with the shaft for integral movement therewith, a holding element disposed in a fixed position relative to the shaft, an arresting element extending between the shaft and the holding element for connection alternately with the shaft and the holding element, an energy storage device operative when the arresting element is coupled with the shaft for storing potential energy and operative to release the stored potential energy when the arresting element is coupled with the holding element for abruptly moving the lever to the arresting element for pivoting the shaft.

2. The device in accordance with claim 1, characterized in that the energy storage device comprises a helical spring extending between the lever and the arresting element.

3. The device in accordance with claim 1, characterized in that the holding element comprises an interiorly toothed segment.

4. The device in accordance with claim 1, characterized in that the arresting element comprises a piston-and-cylinder assembly for selective coupling with the shaft or the holding element.

5. The device in accordance with claim 1, characterized in that the shaft is connected with a drive element operative for imparting the potential energy to the energy storage device.

6. The device in accordance with claim 5, characterized in that the drive element is a stepping motor movable in predetermined angular steps.

7. The device in accordance with claim 1, characterized in that the arresting element comprises another lever.

8. The device in accordance with claim 1, characterized in that, when the arresting element is fixedly coupled with the shaft for integral movement therewith, the lever and the arresting element are disposed at an angle of between about 10 degrees and about 90 degrees to each other.

9. The device in accordance with claim 8, characterized in that the lever and the arresting element are disposed at an angle of about 45 degrees to each other.

* * * * *